United States Patent [19]

Redick

[11] Patent Number: 4,576,810

[45] Date of Patent: Mar. 18, 1986

[54] CARBON FIBER PRODUCTION

[75] Inventor: Hugh E. Redick, Simpsonville, S.C.

[73] Assignee: E. I. Du Pont de Nemours and Company, Wilmington, Del.

[21] Appl. No.: 520,526

[22] Filed: Aug. 5, 1983

[51] Int. Cl.[4] ..... D01F 9/12

[52] U.S. Cl. ..... 423/447.1; 423/447.4; 423/447.6; 423/447.2; 264/29.2; 242/118.1; 242/118.32

[58] Field of Search ..... 423/447.1, 447.4, 447.6, 423/447.2; 264/29.2; 242/118.32, 118.1, 118.3

[56] References Cited

U.S. PATENT DOCUMENTS

| | | | |
|---|---|---|---|
| 3,664,900 | 5/1972 | Cuckson et al. | 423/447.1 |
| 3,826,611 | 7/1974 | Stuetz | 423/447.6 |
| 3,833,182 | 9/1974 | Wilcox et al. | 242/118.32 |
| 3,871,601 | 3/1975 | Crawford et al. | 242/118.32 |
| 4,193,252 | 3/1980 | Shepherd et al. | 423/447.1 |
| 4,335,089 | 6/1982 | Maruyama et al. | 423/447.4 |
| 4,351,816 | 9/1982 | Schulz | 423/447.4 |

FOREIGN PATENT DOCUMENTS

| | | | |
|---|---|---|---|
| 47-26971 | 7/1972 | Japan | 423/447.1 |
| 1295289 | 11/1972 | United Kingdom | 423/447.6 |

*Primary Examiner*—William R. Dixon, Jr.
*Assistant Examiner*—Steven Capella

[57] ABSTRACT

The oxidation of carbon fibers from pitch is carried out directly by winding the spun fibers on to a spinning spool or bobbin, said spool comprising an open ended, porous, non-expanding or collapsible spool. The spun carbon fibers are wound on such a spinning spool so as to leave open areas between fiber bundles. A mixture of an inert gas such as air or nitrogen containing a minor amount of oxygen is used as the oxidizing gas. Oxidation is carried out in a closed zone, e.g. an oven, for a period of time of at least 4 hours at a temperature that is initially below the glass transistion temperature of the carbon fibers and is slowly increased over the oxidation time to a maximum of about 340° C. The gaseous oxidation atmosphere is continuously recycled and passed through the spool to ensure that the fibers are essentially completely oxidized.

12 Claims, 1 Drawing Figure

CARBON FIBER PRODUCTION

FIELD OF THE INVENTION

The present invention relates to a process for the oxidation or thermosetting of carbon fibers obtained from pitch or other carbonaceous materials.

BACKGROUND OF THE INVENTION

As is now well established, carbon fibers can be effectively derived from petroleum pitch as well as from other carbonaceous materials such as coal tar oils. In general, the overall process involves first treating the feed material to convert at least a portion thereof to a mesophase fraction containing from 40% to 100% mesophase. These initial procedures include solvent extraction to separate neo-mesophase or mesophase fractions. Heat treatment by itself or in combination with solvent extraction has also been utilized to obtain or to increase the mesophase portion of the feed material. The goal of these initial treatments is to obtain from the feed material a maximum amount of spinable mesophase material and also material which will give spun carbon fibers having the desirable tensile strength and Young's modulus characteristics.

Conventional spinning apparatus is employed to produce from about 500 to 3000 fibers having diameters ranging from about 8 to 15 microns. The "green" spun carbon fibers are collected in the usual manner on a spinning spool or bobbin. Since the as-spun fibers are weak and easily damaged, it has been customary to render them infusibly by a separate oxidation or thermosetting treatment step. After such a treatment the fibers are subjected to a carbonization step to convert the spun carbon fibers to usable product fibers having fixed tensile strengths and Young's modulus.

Oxidized pitch fibers are known to be easier to handle than unoxidized carbon fibers because of an increase in tensile strength. However, the present method of unwinding the "green" carbon fibers from the spinning spools and oxidizing the fibers as yarns or strands is both time-consuming and expensive in terms of the equipment needed. Thus, for example, a one pound spool of 1000 filaments contains approximately 8635 of carbon fiber. A typical commercial oxidation oven for unwinding the green fiber and for oxidizing them would be at least 50 feet in length and retention time would be one hour. Consequently, such an oxidation procedure would require at least 172 hours to process this one-pound spool of fibers. It follows therefore that there is need for other procedures whereby the oxidation or thermosetting of the fibers can be achieved in much less time and without the need to utilize elaborate and expensive equipment.

As will be understood by those skilled in this field, high strength graphite fibers produced from rayon and polyacrylonitrile (PAN) require controlled stretching during oxidation in order to obtain the orientation necessary to produce high tensil strength, carbonized fibers. Oxidation of these fibers is therefore done by unwinding of the fibers and tensioning them over rolls or godets during oxidation. In contrast, pitch fibers do not require stretching during oxidation because the orientation necessary for high tensile strength occurs during the spinning step. Nevertheless, present practice for the oxidation of pitch fibers is to unwind these fibers and pass them through a heated zone using low tension or on a conveyor belt. For 10 to 15 micron fibers an oxidation retention time of at least one hour, as discussed above, is required due to the diffusion time of oxygen into the fiber.

The need to increase the production speed of carbon fibers is recognized in a recent U.S. Pat. No. 4,351,816, to Schulz. It is interesting to note that in this patent conventional oxidizing or thermosetting procedures are followed. The delicate nature of the spun fibers is recognized, even after infusibilization, and the invention disclosed and claimed therein is directed to an improvement in the carbonization and pyrolysis treatment where breakage increases due to a loss of load-bearing capacity of the thermoset carbon fiber as it is raised from room temperature to about 700° to 800° C. This places a limitation on production rate.

U.S. Pat. No. 4,351,816 further reveals by implication that production rate could also be achieved by providing new procedures for oxidation or thermosetting. However, improvement in this area is more difficult than even the Schulz development for the carbonization step, since the as-spun fibers (i.e. the green fibers) are more fragile at this stage than ater thermosetting, which is what Schulz was dealing with in his procedure.

There have also been a number of prior art proposals which address the problems caused by the exothermic nature of the oxidation treatment of carbon fibers. In thes proposals a substance or mixture of substances is applied to the surfaces of the as-spun fibers prior to the oxidation or thermosetting treatment. U.S. Pat. No. 4,275,051 to Barr utilizes an aqueous finishing composition comprising a dispersion of graphite or carbon black in water. The aqueous solution also contains water-soluble oxidizing agents and surfactants. According to Barr, penetration of the graphite or carbon black particles between the filaments results in greater lubricity between filaments thereby preventing physical damage to the fiber surfaces during subsequent processing. Improved penetration of the oxidizing gas is also said to occur, which helps reduce oxidation time, exothermic excursion and filament fusions. Such fusions are highly undesirable, since they reduce the flexibility and tensile strength of the fiber products.

Aside from the need to formulate a special finishing composition and the added step of applying the finishing soulution to the as-spun fibers, the Barr procedure has the further disadvantages of adding potential impurities into the system.

OBJECTS OF THE INVENTION

One object of the present invention is to provide an oxidation treatment for carbon fibers spun from pitch or other carbonaceous matter which avoids the disadvantages of the presently available procedures.

Another object of the present invention is to provide an oxidation treatment which will reduce the time necessary for effecting infusibilization of the as-spun carbon fibers.

A further object of the present invention is to provide an oxidation or thermosetting procedure whereby the as-spun fibers can be treated while still on the spinning spool or bobbin and does not require either the use of a special finishing solution or special equipment for unwinding the as-spun fibers and then oxidizing individual strands or yarns thereof.

These and other objects will become more readily understood from the ensuing detailed description of the invention.

SUMMARY OF THE INVENTION

In accordance with the present invention it has now been found that carbon fibers from pitch and other carbonaceous material may be oxidized directly on the spinning spool by utilizing a non-expanding or collapsible porous spool with at least one open ended face for winding the spun pitch fibers and by subjecting the so-called fiber package, i.e., spun fiber wound on the spool, to a mixture of oxygen and an inert gas or to air in a closed chamber. Another feature of the invention comprises winding the pitch fibers on the porous spool in such a manner that open areas or patterns of open areas are created between the fiber bundles on the fiber package. The latter feature ensures uniformity of oxidation.

DETAILED DESCRIPTION OF THE INVENTION

Figure 1:
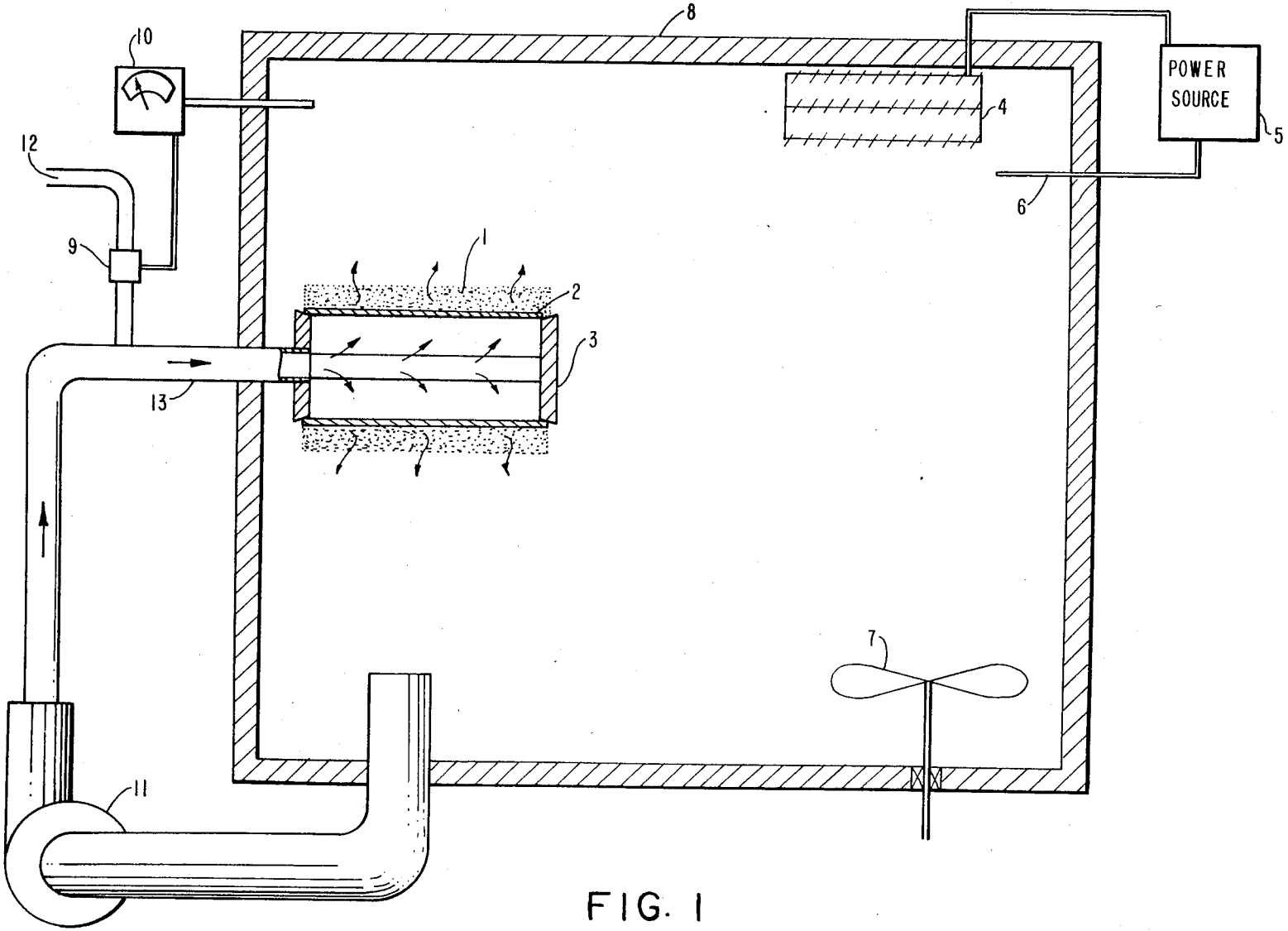

In attempting to develop an improved method for oxidizing a pitch carbon fiber utilizing a densely packed mass of as-spun fibers such as those wound on a spool or bobbin, three major problems were encountered.

1. Controlling the exothermic reaction.
2. Preventing fiber damage resulting from fiber shrinkage during oxidation.
3. Uniformly supplying the oxidizing gas throughout the fiber package.

It was found that the exothermic problem could be eliminated or minimized by utilizing an oxygen-inert gas mixture to supply only a controlled amount of oxygen to the fiber. Also the rate of oxidation was reduced from about 1 hour to from about 3 to 12 hours, preferably about 7 hours. On the other hand, fiber damage due to shrinkage during oxidation was prevented by using a non-expanding or collapsible spool or bobbin for winding the as-spun pitch fibers. Finally, uniformity of oxidation was achieved by winding the as-spun pitch fibers on the porous spool in such a manner that open areas were deliberately created between the fiber bundles or yarns on the spool package. During oxidation the mixture of oxygen and inert gas is forced through the fibers constituting the spool package to attain uniform oxidation as well as uniform exposure to the oxygen-inert gas mixture.

The inert gas used in admixture with the nitrogen is preferably nitrogen, although other inert gases such as carbon dioxide, argon, etc. may be employed. For some purposes steam or air may be utilized. In general the amount of oxygen in the gaseous admixture will range from about 4 to 15%, and preferably from about 4 to 8% by volume, based on the total amount of gases present in the closed chamber or oven utilized to carry out the improved oxidation procedure of this invention. When air is employed the oxygen content will be about 20.9% by volume.

For most purposes the temperature under which oxidation is carried out will range from about 200° to 340° C., and preferably from about 225° to 300° C. It has been found advantageous to slow the rate of oxidation over a period of time that is at least 3 hours, preferably from about 6 to 8 hours. Moreover, oxidation of fibers wound on a spool is begun at a temperature below the glass transition temperature (Tg) of the pitch fibers and to maintain increases in the temperature at a rate slow enough to ensure oxygen diffusion to the center of the fiber before loss of liquid crystal orientation. It is obviously important to maintain this crystal structure, imparted to the fiber during spinning throughout the oxidation treatment.

The spinning spools or bobbins useful for the purposes of this invention are porous, non-expanding or collapsible. An example of such a spool is a collapsible spool made from screen wire 60 mesh which has been cut on 45 degrees bias.

As described above on a non-expandable or a contractable, porous spool or bobbin. The spool may be made from wire mesh, slotted aluminum metal, perforated aluminum metal, and polymeric resins or composites thereof such as aramid (i.e. Kelvar) and polyimide, or the like. A particularly useful spool is described in U.S. Pat. No. 4,527,754 which is, in general, a carbon fiber composite with a high temperature thermosetting resin, e.g., polyimide. This spool is open ended and provided with a plurality of geometrically or randomly disposed holes or openings to facilitate the passage of the oxidizing gas into the fibers.

As also previously mentioned, a further feature of the present invention is the discovery that uniformity of oxidation is aided, if not ensured, by winding the pitch fibers on the porous, non-expandable or collapsible spool in such a manner that open areas are deliberately created between the fiber bundles. Repeated patterns in the wound fibers can be developed utilizing a transversing guide which gathers the fibers and moves the fiber parallel to the axis of the spool as the spool rotates. Thus, for example, a repeated pattern of fibers can be established by returning the traverse guide to the same location, axially and circumferentially, and moving it in the same direction after an integral number of spool revolutions.

The invention will be more fully understood by reference to FIG. 1 which is a block diagram showing the oxidation of as-spun pitch carbon fibers 1 wound, in a repeating pattern on a porous, non-expanding spool 2 in a closed zone or oven 8 as well as from the following description of the preferred method of carrying out the invention, which is thus an illustrative embodiment.

Carbon fibers 1 are spun from a conventional spinerette (not shown) containing a spinning head having approximately 500 holes. The as-spun fibers are would on a 6 inch diameter porous, collapsible spool 2 made from 60-mesh screen wire cut on a 45 degree bias. Fibers 1 are wound on spool 2 using a diamond pattern which repeats after 32 spool revolutions to produce 160 diamond areas. Spool 2 containing the wound fibers 1 is placed on mandrel 3 in an insulated oven 8. The blower manifold 13 injects the gaseous atmosphere in oven 8 through porous spool 2 and fibers 1. Pressure blower 11 recirculates the gaseous oxidizing atmosphere in the oven through spool 2. A gaseous mixture of nitrogen and 7% oxygen is furnished through inlet gas line 12 and control valve 9. The amount of oxygen in the gaseous atmosphere of oven 8 is controlled by use of oxygen level instrument 10. Heater 4 is used to supply heat to oven 8, and the former's power source 5 is controlled by thermocouple temperature sensor 6. Fan 7 is used to circulate the gaseous atmosphere in oven 8 and to maintain uniform temperatures.

Initially the carbon fibers are heated for 2 hours at a temperature of 200° C. in the gaseous atmosphere containing about 7% oxygen. While maintaining the same oxygen level, the oven temperature was raised to 265° C. for 1 hour and then to 300° C. for another hour. Oxidation was completed in one additional hour by raising the oxygen level to 10% while maintaining the 300° C. temperature.

Analysis of the thus oxidized pitch carbon fibers revealed substantially complete fiber oxidation without loss of crystal structure.

It will be understood that both long and relatively short oxidation cycles may be utilized in the practice of the present invention. The preferred cycle is illustrated above, although it may be varied somewhat or expressed differently to encompass other temperature proviles, such heating the as-spun carbon fibers at about 200° C. for 30 minutes, increasing the temperature grradially over about a 7 hour period until the temperature is 275° C., holding it at that temperature for 3 hours, increasing the temperature to 300° C. over a 30 minute period, and then completely oxidation at 300° C. in about 15 minutes. Short oxidation cycles utilize air as the oxidant and initially heat the as-spun carbon fibers at 225° C. for 30 minutes. The temperature is then raised over a period of 1 hour to 265° C. and held there for 3 hours until the oxidation treatment is completed.

Although the present invention has been described in connection with a preferred embodiment thereof, many variations and modifications will now become apparent to those skilled in the art.

What is claimed is:

1. A pitch fiber package suitable for direct oxiadation with a gaseous mixture containing oxygen and an inert gas which comprises an open ended, porous, non-expanding or collapsible spool with a densely packed mass of as-spun pitch carbon fibers wound thereon so as to leave open areas between fiber bundles.

2. The pitch carbon fiber package of claim 1 wherein the spun pitch carbon fibers are wound on the spool with repeated patterns having open areas between fiber bundles.

3. A method for oxidizing spun pitch carbon fibers wound on a spinning spool which comprises winding said pitch carbon fibers on said spool in a manner so that open areas are left between bundles of fibers and so that a densely packed mass of as-spun pitch carbon fibers is formed on said spool; said spool being open ended, porous and non-expanding or collapsible; initiating oxidation of the densely packed as-spun pitch carbon fibers at a temperature below the glass transition temperature of the pitch carbon fibers in a closed heating zone with a gaseous mixture of an inert gas and a minor amount of oxygen; increasing the temperature to a maximum of about 340° C. over a period of time at least sufficient to attain oxygen diffusion to the center of the pitch carbon fibers without loss of crystal orientation in the pitch carbon fibers; and wherein said gaseous oxidation mixture is passed into the open ends of said porous spool and through the open areas between said wound pitch carbon fiber bundles.

4. The method of claim 3 wherein said inert gas is nitrogen.

5. The method of claim 3 wherein the amount of oxygen in said gaseous admixture is about 1 to 15% by volume.

6. The method of claim 3 wherein said gaseous mixture is air.

7. The method of claim 3 wherein the initial oxidation temperature is 200° C.

8. The method of claim 3 wherein the oxidation temperature range is from about 225° to 300° C.

9. The method of claim 3 wherein the oxidation time period is at least 3 hours.

10. The method of claim 8 wherein the oxidation time period ranges from about 4 to 8 hours.

11. The method of claim 3 wherein the spool is made of screen wire, slotted aluminum metal, perforated aluminum metal, and polymeric resin.

12. The method of claim 3 wherein the spool is made from a multi-ply, multi-directional woven graphite cloth, hoop carbon fiber filaments, and a thermosetting resin.

* * * * *